United States Patent [19]

Buck

[11] 4,335,483

[45] Jun. 22, 1982

[54] TANDEM ROLLER DEVICES FOR APPLYING COATING LIQUIDS

[76] Inventor: Richard F. Buck, 41 Deer Hill Cir., Westbrook, Me. 04092

[21] Appl. No.: 148,684

[22] Filed: May 12, 1980

[51] Int. Cl.[3] ..... B05C 1/08; B05C 17/02

[52] U.S. Cl. ..... 15/230.11; 29/110.5; 29/120

[58] Field of Search ..... 15/230.11, 248 A; 29/110.5, 116 R, 120, 130

[56] References Cited

U.S. PATENT DOCUMENTS

| | | | |
|---|---|---|---|
| 2,813,292 | 11/1957 | McLendon | 15/230.11 |
| 2,835,915 | 5/1958 | Pearson | 15/248 |
| 3,058,145 | 10/1962 | Hegedus | 15/248 X |
| 3,157,135 | 11/1964 | Fetrow et al. | 15/230.11 X |
| 3,263,260 | 8/1966 | Filler | 15/230.11 |
| 3,562,837 | 2/1971 | Baginski et al. | 15/230.11 |
| 3,638,939 | 1/1972 | Langley | 15/230.11 X |

FOREIGN PATENT DOCUMENTS

| | | | |
|---|---|---|---|
| 75804 | 5/1953 | Denmark | 15/230.11 |
| 1106159 | 7/1955 | France | 15/230.11 |
| 1390356 | 1/1965 | France | 15/230.11 |

*Primary Examiner*—Edward L. Roberts

[57] ABSTRACT

A device for applying coating liquids to a surface has primary and secondary units that are interconnected with the interconnection including a handle. Each roller is provided with a surface layer that readily absorbs the coating liquid. The primary unit is for use in applying the coating liquid with the roller of the secondary unit providing support when both rollers are held against the surface. In practice, the roller of the secondary unit is shorter than that of the primary unit and the interconnection enables the secondary unit to be detached and used by itself or while still attached.

4 Claims, 4 Drawing Figures

TANDEM ROLLER DEVICES FOR APPLYING COATING LIQUIDS

BACKGROUND REFERENCES

U.S. Pat. No. 3,130,435
U.S. Pat. No. 3,205,526
U.S. Pat. No. 3,340,131
U.S. Pat. No. 3,649,986
U.S. Pat. No. 4,000,537

BACKGROUND OF THE INVENTION

Roller devices are widely used to apply coating liquids to surfaces. Such devices have their handles extending at right angles to the axis of the roller from the center thereof. The rollers have a surface layer that readily absorbs the liquid to be applied.

In the use of such a device, the surface layer is charged as by rolling the roller in a tray containing a supply of the liquid and the liquid applied by movement of the roller over the surface to deposit a uniform layer thereon. Such use requires both the application of considerably pressure to the roller and against the surface and a generally opposite force to maintain the handle in position as a consequence of which the use of the device is quite fatiguing.

THE PRESENT INVENTION

The general objective of the present invention is to provide devices to apply a coating liquid by means of rollers that are less fatiguing to use than the above referred-to conventional devices.

In accordance with the invention, this general objective is attained with a device provided with primary and secondary units with each unit having a rotatable coat-applying member with at least that of the primary unit a roller. A handle interconnecting the two units centrally of the device extends lengthwise thereof. The primary unit is for use in applying the liquid while the seconary unit functions as a support enabling the only working force to be that holding both roller against the surface while moving the device relative thereto.

Another objective of the invention is to ensure that the full advantage of the secondary unit for the above purpose is attained, an objective attained by providing that the axial extent of the rotatable member of the secondary unit is substantially less than that of the primary unit.

Another objective of the invention is to enable the secondary unit to be used by itself, an objective attained by providing that its rotatable member is also a roller and that there is a detachable connection between the two units that provides the secondary unit with a handle when detached. With the secondary unit detached, it can, because of its relatively short roller, be advantageously used in applying a coating liquid where the length of the roller of the primary unit precludes its use.

A preferred construction of the primary unit is one that employs a rod shaped and disposed with one end a shaft on which a roller is secured by a retainer fixed on the free end thereof with the rod bent when it protrudes from the other end of the roller to extend away therefrom. With such a construction yet another objective of the invention is to enable the device to be inverted to reverse the lay of the roller of the primary unit, an objective attained with the device having a connection between the two units enabling one to be turned relative to the other through at least 180° so that when the device is thus disposed, the rotatable member of the secondary unit can be positioned to engage the surface being coated with the handle spaced therefrom.

Other objectives of the invention will be apparent from the accompanying specification and the appended claims.

BRIEF DESCRIPTION OF THE DRAWINGS

The accompanying drawings illustrate a preferred embodiment of the invention and its use in comparison with the use of a prior art device with FIG. 1 illustrating the use of the prior art device.

THE PREFERRED EMBODIMENT OF THE INVENTION

Figure 1:
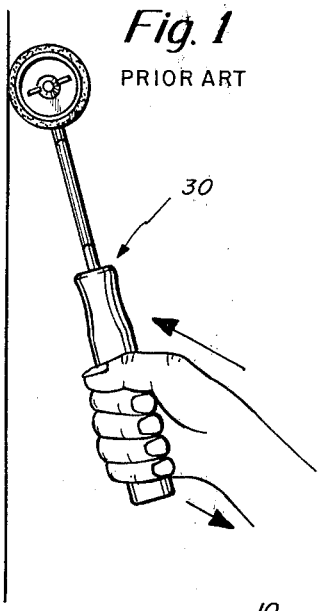
Fig. 1 PRIOR ART
Figure 2:
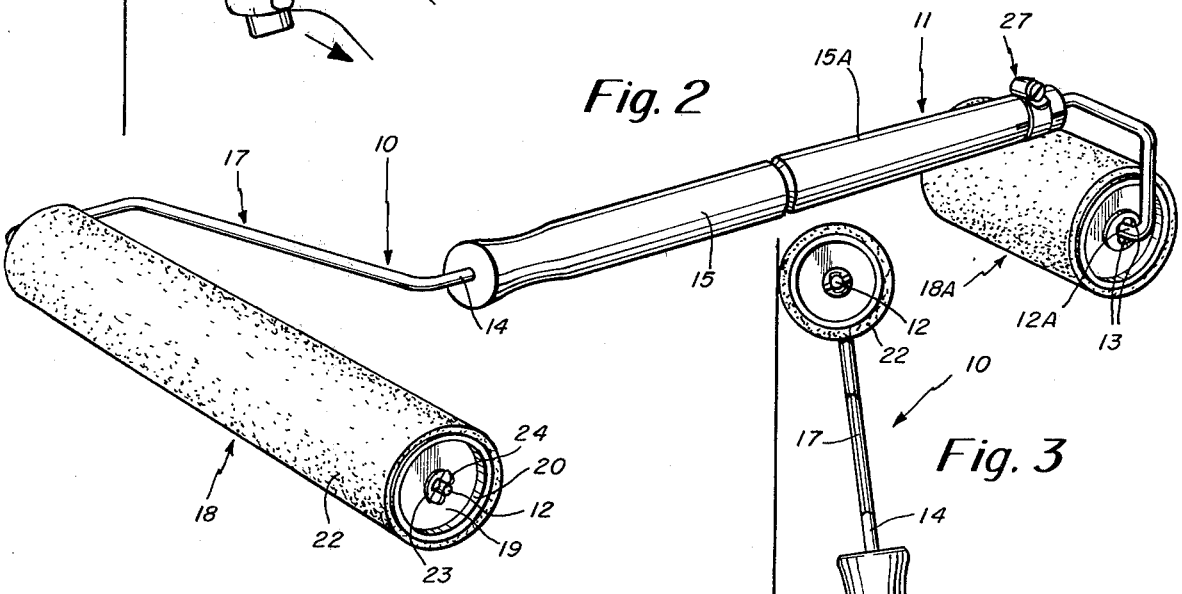
FIG. 2 is a partly sectioned perspective view of a device in accordance with the invention.

The tandem device illustrated by the drawings has a primary unit generally indicated at 10 and a secondary unit generally indicated at 11. As the units are, in general, of a similar construction, that of the primary unit will be detailed and corresponding parts of the secondary unit 11 not described but identified by the suffix addition A applied to the appropriate reference numerals.

The primary unit 10 has a rod so bent as to provide one end portion 12 that serves as an axle with stops, not shown, spaced from the free end thereof, and identical to the stops 13 on the axle portion 12A of the secondary unit 11. The other end portion 14 of the rod is straight and entrant of one end of a handle 15 having a threaded socket 16 in its other end while an intermediate portion 17 of the rod has bends so formed and disposed as to position the end portion 14 at right angles to the center of the axle portion 12 but spaced from the roller, generally indicated at 18 when mounted thereon. The rod portions 12, 14 and 17 are all in the same plane.

The roller 18 is shown as of the type having a pair of identical discs 19 each flanged as at 20 and 21 both to provide support for the ends of a hollow cylindrical body 22 provided with a surface layer that readily absorbs the liquid to be applied and to confine the ends thereof when one disc 19 is backed by a washer 23 against the stops 13 and the other disc 19 is held as by a wing nut 24 threaded on the free end of the axle 12 against a washer 23. The primary unit 10, as thus described, is of a type widely used except for its threaded socket 16.

In accordance with the invention, the secondary unit 11 differs from the primary unit 10 in that the length of its roller 18A is substantially less than that of the roller 18, the free end 25 of its handle 15A is threaded for entry into the socket 16 of the primary unit, its axle portion 12A, while parallel to the axle portion 12, extends in the opposite direction, and the three bends of its intermediate portion 17A are right angular and disposed to position the end of the portion 14A that is proximate the roller 18A above the center thereof thus to space the handles 15 and 15A, when interconnected, from the surface to be coated so that they may be manually held without contact therewith. As the diameter of the roller 18A is shown as the same as that of the roller 18, the interconnected handles 15 and 15A are downwardly inclined towards the axis of the roller 18.

Figure 4:
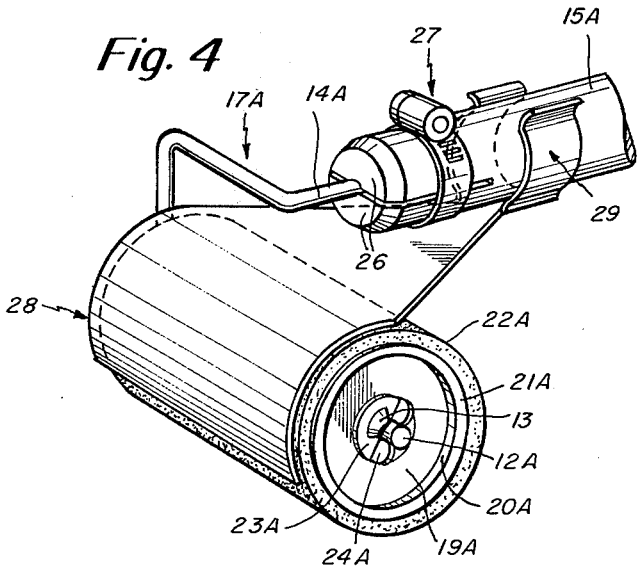
FIG. 4 is a fragmentary perspective view of the device with a guard detachably attached thereto and overlying the roller thereof.

In order to ensure that the axes of both rollers, when the two units are interconnected, will be in the same plane, an additional feature of the invention is that one of the units, the secondary unit 11 in the disclosed embodiment, has its rear end transversely divided to provide jaws 26, best seen in FIG. 4, encircled by a clamp 27 enabling the end portion 14A to be secured while permitting such turning of one device relative to the other as to bring their axes parallel.

It will be appreciated that where the intermediate rod portion 17 joins the axle portion 12, it holds the proximate end of the roller 18 away from adjacent framework. In that case, the device is inverted in a manner reversing the lay of the roller 18 to enable the surface abutting the framework to be coated. With the secondary unit 11 turned 180°, the roller 18A is again positioned for supporting engagement with the surface to be coated with the handle spaced therefrom.

It is preferred, see FIG. 4, to provide the secondary unit with a guard 28 for the roller 18A and provided with a resilient clip 29 enabling the guard to be detachably attached to the handle 15A. The guard is desirably of the same length as the roller 18A and is dimensioned to so encircle it as to serve as a stop engageable with framework, mop boards, etc. to prevent the roller 18A from coming in contact therewith.

An important feature of devices in accordance with the present invention is that either unit may be used by itself in a conventional manner. In practice, it is typically the unit 11 that is so used as its short roller 18A is well adapted for use where the use of the unit 10 would be difficult or impossible. In practice, rollers 18A in the two to four inch range have proved satisfactory. Typically, the rollers 18 are in the seven to nine inch range.

Figure 3:
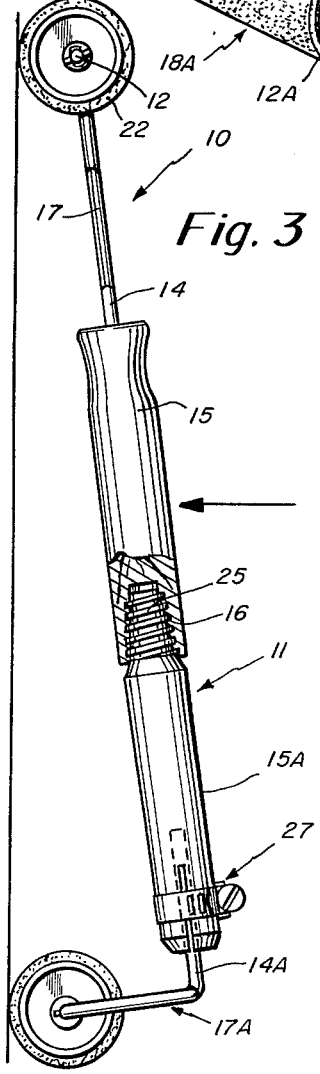
FIG. 3 is a side view of the device illustrating its use.

In the preferred use of the tandem roller device, the roller 18 of the primary unit is used to apply the coating liquid with the roller 18A serving as a supporting roller enabling the device to be used with working pressure applied generally in the direction of the arrow in FIG. 3. In FIG. 1, a coventional roller device, generally indicated at 30, requires relatively opposite working force to be applied generally in the direction of the two arrows. From a comparison of the two views, it will be apparent that the use of a device is far less fatiguing than in the case with a conventional roller device with a reduction in effort in the thirty to forty-five percent range depending on the angle at which a conventional device is held. In addition, the use of tandem rollers enables either hand to be used and the device easily and accurately guided by either. The combined length of the handles 15 and 15A ensures an increased reach.

I claim:

1. A tandem device for applying a coating to a surface, said device including primary and secondary rotatable members of which at least the primary member is a roller and the axial extent of the secondary member is substantially less than that of said roller, and means interconnecting said members with their axes parallel and spaced a substantial distance apart with said secondary member in the path of the primary member, said connecting means including member supporting end portions, the end portion for the primary member being in the form of a shaft entrant of said primary member from one end thereof, said connecting means including a handle portion extending between said members in a direction normal to said axes and in a position between the ends of the primary member and a length less than the distance between the members, said handle portion spaced above a plane inclusive of said axes and enabling, when both members are in contact with said surface, the only necessary working force to be applied in a direction substantially normal thereto, and said connecting means also including means enabling one of said members to be turned through an arc of at least 180° thereby to enable said device to be inverted to reverse the lay of the roller of its primary unit with the secondary member engageable with the surface and the handle portion spaced therefrom.

2. The tandem device of claim 1 in which said connecting means includes a rotatable connection with said handle means.

3. The tandem device of claim 1 in which the handle portion includes two sections, one for each of said other member and connected thereto, and means detachably connecting said handle sections enabling either member to be used by itself.

4. The tandem device of claim 1 in which the handle portion includes two sections threaded together end-to-end.

* * * * *